United States Patent [19]

Liggett

[11] Patent Number: 5,033,613

[45] Date of Patent: Jul. 23, 1991

[54] CARRYING PACKAGE AND RECEPTACLE FOR A SOAP PRODUCT

[76] Inventor: James R. Liggett, Rte. 12A, R.R. 2, Box 911, Cornish, N.H. 03745

[21] Appl. No.: 569,824

[22] Filed: Aug. 20, 1990

[51] Int. Cl.[5] ..... B65D 81/24

[52] U.S. Cl. ..... 206/77.1; 206/205; 383/72; 383/121.1

[58] Field of Search ..... 206/77.1, 204, 205, 206/210, 581, 823; 383/72, 75, 121.1

[56] References Cited

U.S. PATENT DOCUMENTS

| | | | |
|---|---|---|---|
| 1,029,105 | 6/1912 | Clarke | 206/581 |
| 1,349,727 | 8/1920 | Mock | 383/121.1 |
| 3,377,121 | 4/1968 | Billesbach et al. | 206/77.1 |
| 4,733,426 | 3/1988 | George | 206/77.1 |

FOREIGN PATENT DOCUMENTS

| | | | |
|---|---|---|---|
| 0021120 | 9/1956 | Fed. Rep. of Germany | 206/77.1 |
| 1914415 | 10/1970 | Fed. Rep. of Germany | 206/77.1 |

*Primary Examiner*—Jimmy G. Foster
*Attorney, Agent, or Firm*—Wolf, Greenfield & Sacks

[57] ABSTRACT

A combined carrying package and soap bar receptacle structure is disclosed. The structure comprises a pair of aligned plates adapted to receive a soap bar product therebetween. The surfaces of the plates in contact with the soap bar product have a plurality of spaced-apart parallel grooves extending between from opposite sides of each of the plates. A carrying bag is in contact with the bottom plate and is sealed at its top end with a drawstring or other closure.

15 Claims, 1 Drawing Sheet

CARRYING PACKAGE AND RECEPTACLE FOR A SOAP PRODUCT

BACKGROUND OF THE INVENTION

This invention pertains to a device which is adapted to serve as a storing, carrying, handling, and drying package for a bar of soap or shampoo.

Soap bar products which include, but are not limited to, bar soaps and bar shampoos are typically packaged in a cardboard box with a paper wrapper, both of which are adapted to be thrown away when the package is opened. Moreover, packaging materials for soap bar products are often not suitable for storage or carrying since they tend to disintegrate or leak when wet. A product does not currently exist which serves as a packaging for the product, and which can also be used for storing, handling, drying and carrying the product.

It is therefore an object of this invention to provide an improved packaging for a soap bar products, and in particular to provide a structure which can be used while traveling. The structure can carry a potentially sticky bar of soap or shampoo and dry the bar without the bar sticking to, or leaking to anything else it is packed with.

SUMMARY OF THE INVENTION

In accordance with the above, this invention provides a structure which functions as a combined carrying package and receptacle for a soap bar product. The structure includes a base plate and a top plate, which plates are preferably formed of wood.

One surface of the soap bar product is in contact with the base plate and an opposite surface of the soap bar product is in contact with the top plate. A cover is in contact with the base plate and projects above the top plate to define a hollow carrying bag. A closure element is attached to the hollow bag. The base plate, and also preferably the top plate, further have a plurality of parallel spaced grooves incised therein, the grooves extending between opposite sides of the plate.

The foregoing and other objects, features and advantages of the invention will be apparent from the following more particular description of a preferred embodiment of the invention as illustrated in the accompanying drawing.

DETAILED DESCRIPTION OF THE DRAWING

DETAILED DESCRIPTION

Figure 1:
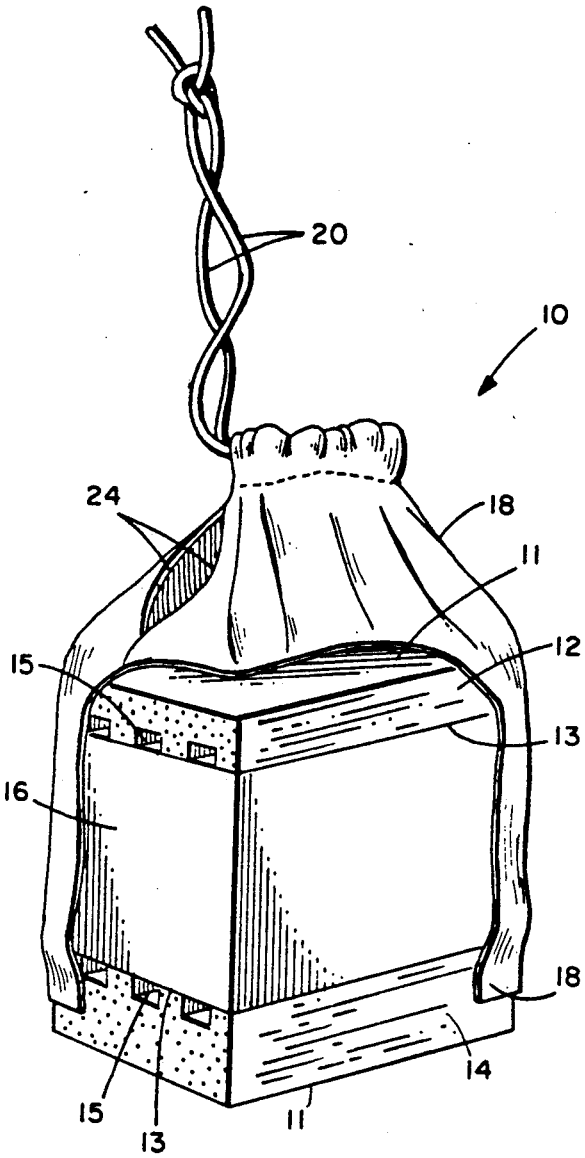
FIG. 1 is a partially cut away view of the cover and soap bar receptacle of a first embodiment of the invention.

Referring to FIG. 1, the structure 10 of this invention is in the form of a substantially rectangular top plate 12 and a substantially rectangular base plate 14. The plates 12,14 have substantially equal areal dimensions, and are of finite thickness. Base plate 14 is preferably substantially thicker than top plate 12. Each plate has an exterior surface 11 and interior surface 13. The width and length of each of the plates 12 and 14 are such that a soap bar product 16 can be disposed between the two interior surfaces 13. As previously indicated, the soap bar product 16 would normally be either a soap bar or a shampoo bar.

A plurality of parallel spaced grooves 15 extend between opposite sides of interior surface 13 of the bottom plate 14 that contacts the soap bar product 16. Preferably, grooves 15 are formed on the interior surface 13 of top plate 12, as well. Grooves 15 are preferably evenly spaced. The grooves may be of any depth, but should be of sufficient depth to let air freely circulate underneath a wet bar of soap or shampoo to allow the bar a chance to dry. Grooves 15 are generally rectangular in cross section but may be of arcuate, or other, shape.

The top plate 12 and bottom plate 14 may be formed of the same material, such as for example, wood or plastic, or may be formed of different materials. For the preferred embodiment, the plates of structure 10 are formed of wood. In a particularly preferred embodiment, the wood is a porous wood, such as pine. In this embodiment, the porous wood tends to absorb moisture and draw the moisture away from the soap bar product. This characteristic is important in combination with the cover 18, as discussed below.

When used as a carrying and drying package, the interior surfaces 13 of base plate 14 and top plate 12 receive a soap bar product 16 fitted therebetween. A cover 18 is in contact with the base plate 14. For some embodiments of the invention, this cover 18 is affixed or otherwise sealed to the base plate 14 and projects above the level of the top plate 12 to define a hollow bag. Preferably, the cover 18 is affixed to the outer periphery of the base plate 14, as shown in FIG. 1. Conventional element such as glueing, nailing, stapling, pressure fitting or the like may be used to affix the cover 18 to the base plate 14. For a preferred embodiment, the cover 18 is glued to plate 14 with a water-impervious adhesive.

Cover 18 has affixed to its open end a closing element 20, designed to close the upper end of the bag and optionally, to carry the receptacle. The closing element can comprise a simple drawstring capable of drawing together the upper edge of the bag. Other closing element can comprise various clips, snaps or the like. If desired, a separate strap or other carrying element may be provided when such closing element are employed.

The cover 18 can be formed of any suitable material. Preferably, the cover is capable of absorbing liquid by capillary, or other similar action, and allowing the liquid to evaporate; in other words, the cover is capable of a "wickinq" action. In a preferred embodiment, the cover 18 is made of canvas. In conjunction with plates 12, 14 made of porous wood, the canvas cover 18 serves to draw moisture off the soap bar product. This facilitates the drying of the soap bar product.

Figure 2:
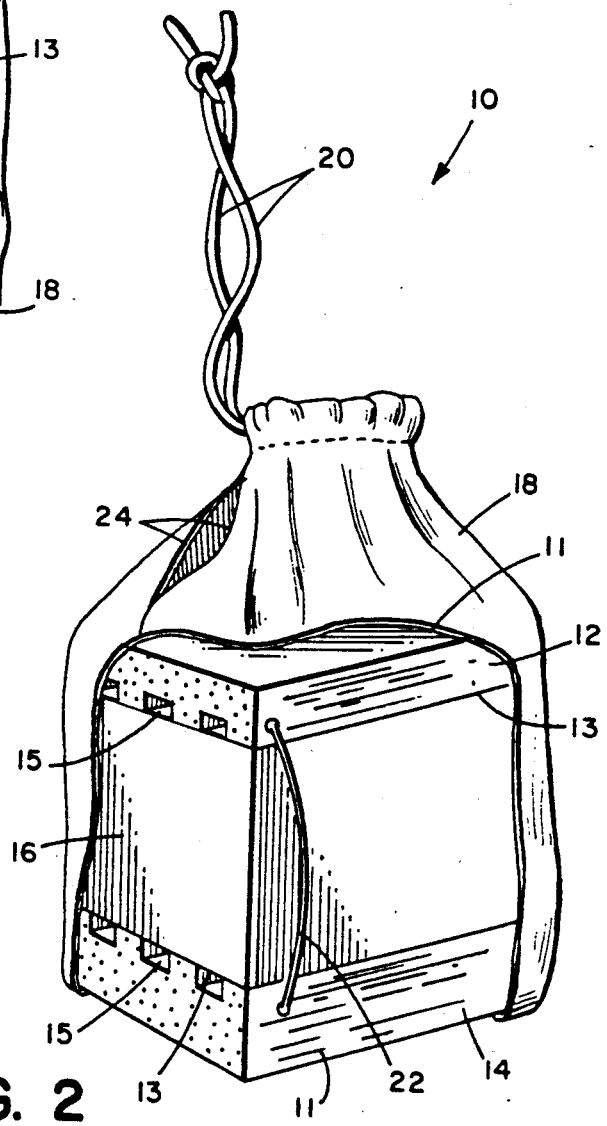
FIG. 2 is a partially cut away view of the cover and soap bar receptacle of an alternate embodiment of the invention.

Referring to FIG. 2, an alternate embodiment of the invention is shown wherein plates 12 and 14 are joined to each other by a tether 22. The length of the tether 22 is such that a soap bar product 16 can be disposed between the interior surfaces 13. The tether 22 can be composed of any material provided that it is not degraded by soaps or liquids. The length of the tether is not critical but must be sufficient to allow a soap bar product 16 to slip between the base 14 and top 12 plates. When used with a tether 22, the cover 18 is not fixed to the base plate 14 but is a one piece unit defining a hollow bag into which the base plate 14 and top plate 12 with soap bar product 16 sandwiched therebetween are placed.

In either embodiment, the cover has a vertical opening 24 extending up one of the sides of the cover. The opening 24 serves as a convenient element for inserting and removing a soap bar product. The opening can preferably be closed by drawstring 20.

Appropriate logos identifying the product may be imprinted on the top plate 12, may be embossed, printed or the like on cover 18, and/or a paper strip (not shown) containing printed matter may be placed over a portion of the cover 18.

The structure 10 shown in FIGS. 1 and 2 is especially designed for handling, drying and carrying a soap bar product while traveling. The structure allows a soap bar product to be transported and dried without sticking to or leaking to anything else it is packed with. During transport, the soap bar product 16 always rests on the base plate 14. Once used, the soap bar product when dried, attaches itself to one or both plates. To remove the soap bar product easily from the plates, one holds the base plate 14 with one hand and gives top plate 12 a slight twist with the other hand, thus freeing the bar from the plates.

To remove the soap bar product 16 for use, the opening 24 is enlarged and cover 18 is peeled back to expose the soap bar product 16 and top plate 12. In the preferred embodiment shown in FIG. 1 in which plates 12,14 are not connected by a tether, the cover 18 and attached bottom plate 14 are then inverted so that the top plate 12 and soap bar product 16 can both be removed leaving the cover 18 attached to the bottom plate 14. In its inverted position, the top plate 12 serves as a temporary base/soap dish for the soap bar product 16 while the latter is being used. After use, the wet soap bar product 16 and top plate 12 are placed back in their original positions inside the cover 18.

In the alternate embodiment in which plates 12, 14 are connected by a tether 22, top plate 12, soap bar product 16, and bottom plate 14 are removed, leaving the free standing cover 18. The top plate 12 can be separated from the bottom plate 14 while the soap bar product 16 is being used. Either plate 12 or plate 14 can serve as a temporary base for the soap bar product while the latter is being used under these circumstances. The tether 22 that connects the base 14 and top plates 12 only functions to keep the two plates from being separated. After use, the wet soap bar product 16 is sandwiched between top plate 12 and base plates 14 and the entire unit is placed into the free standing cover 18.

Those skilled in the art will know, or be able to ascertain using no more than routine experimentation, many equivalents to the specific embodiments of the invention described herein.

These and all other equivalents are intended to be encompassed by the following claims.

I claim:

1. A receptacle structure for a soap bar product having at least two opposed surfaces comprising:

a base plate and a top plate, each plate of finite thickness and having an interior and exterior surface, the plates being aligned and spaced to receive a soap bar product therebetween with the interior surfaces of the plates in contact with opposed surfaces of the soap bar product, a cover in contact with the base plate and projecting above the top plate; and closing means affixed to the cover.

2. The structure of claim 1, wherein the cover has a vertical opening allowing for removal and insertion of at least one of said plates and the soap bar product.

3. The structure of claim 1, wherein at least the top plate and soap bar product are adapted/to be removed from the cover, the top plate functioning as a temporary base for the soap bar product.

4. The structure of claim 1, wherein the interior surface of each of said plates has a plurality of parallel spaced grooves extending between opposite sides of said interior surface.

5. The structure of claim 1, wherein the cover is affixed to the outer periphery of the base plate.

6. The structure of claim 1, wherein the cover is capable of absorbing moisture and allowing the moisture to evaporate.

7. The structure of claim 1, wherein the plates are made of wood.

8. The structure of claim 7, wherein the wood is porous and absorbs moisture.

9. The structure of claim 1, wherein the base plate and the top plate are connected to each other by a tether.

10. The structure of claim 9, wherein said closing means may be opened and closed, and wherein when said closing means is open, the base plate, top plate and soap bar product are removable from the cover, either of said plates being usable as a temporary base means for the soap bar product when said soap bar product is removed from the cover.

11. A combined receptacle and soap bar product, comprising:

(a) a soap bar product;

(b) a parallel pair of plates adapted to receive the soap bar therebetween, said plates having cut therein a plurality of parallel grooves extending between opposite ends of each of the plates, the grooves being cut into a surface of each of the plates in contact with the soap bar;

(c) a cover contacting the base plate and projecting above the level of the top plate, defining a hollow bag; and (d) a closing means attached to the open end of the bag.

12. The soap bar product of claim 11, wherein the cover has a vertical opening allowing for removal and insertion of the soap bar product and at least one of the plates.

13. The soap bar product of claim 12, wherein the plates are made of wood.

14. The soap bar product of claim 13, wherein the wood is porous and absorbs moisture.

15. The soap bar product of claim 14, wherein the cover is capable of absorbing moisture and allowing the moisture to evaporate.

* * * * *